US005269147A

United States Patent [19]

Ishizaki et al.

[11] Patent Number: 5,269,147

[45] Date of Patent: Dec. 14, 1993

[54] PULSE TUBE REFRIGERATING SYSTEM

[75] Inventors: Yoshihiro Ishizaki, Kamakura; Takayuki Matsui, Fujisawa, both of Japan

[73] Assignees: Aisin Seiki Kabushiki Kaisha, Kariya; Ecti Kabushiki Kaisha, Kamakura, both of Japan

[21] Appl. No.: 904,013

[22] Filed: Jun. 25, 1992

[30] Foreign Application Priority Data

Jun. 26, 1991 [JP] Japan ..... 3-154802

[51] Int. Cl.[5] ..... F25B 9/00

[52] U.S. Cl. ..... 62/6; 62/86; 62/467

[58] Field of Search ..... 62/6, 86, 467

[56] References Cited

U.S. PATENT DOCUMENTS

| | | | |
|---|---|---|---|
| 3,237,421 | 3/1966 | Gifford | 62/6 X |
| 3,302,422 | 2/1967 | Smith | 62/6 X |
| 3,314,244 | 4/1967 | Green | 62/6 X |
| 3,431,746 | 3/1969 | Webster et al. | 62/6 X |
| 4,024,727 | 5/1977 | Berry et al. | 62/6 |
| 4,444,019 | 4/1984 | Arkharov et al. | 62/467 X |
| 4,522,032 | 6/1985 | Nakamura | 62/6 |
| 5,107,683 | 4/1992 | Chan et al. | 62/6 |

FOREIGN PATENT DOCUMENTS

| | | | |
|---|---|---|---|
| 0230059 | 9/1990 | Japan | 62/6 |

OTHER PUBLICATIONS

Pulse Tube Refrigeration Progress; "Advances in Cryogenic Engineering", 10B(1965), pp. 69-77: W. E. Gifford & R. C. Longsworth.

A Review of Pulse Tube Refrigeration; "Advances in Cryogenic Engineering", 35(1990), pp. 1191-1205: Ray Radebaugh.

Alternative Methods of the Orifice Pulse Tube Refrigerator; "Proc. 5th Intl. Crycooler Conf", (1988), pp. 127-135: Y. Matsubara & A. Miyake.

Current State of Research of Pulse Tube Refrigeration; "Cryogenic Engineering", vol. 26, No. 2, (1991) pp. 98-107: T. Inoue.

*Primary Examiner*—Henry A. Bennett
*Assistant Examiner*—Christopher B. Kilner
*Attorney, Agent, or Firm*—Oblon, Spivak, McClelland, Maier & Neustadt

[57] ABSTRACT

A pulse tube refrigerating system comprising a compressing cavity for compressing a working fluid, a heat radiator connected with the compressing cavity and a regenerator connected with the heat radiator. A pulse tube is provided and connected with the heat radiator through a refrigerating section. The pulse tube is connected through a heat exchanger and a flow regulating valve with an expansion cavity which is operable with a phase difference with respect to the compressing cavity, whereby the working fluid from the compressing cavity is cooled by the heat radiator and passed through the refrigerating section into the pulse tube, the working fluid in the pulse tube being compressed by the working fluid from the refrigerating section to be increased in temperature and passed to the heat exchanger to radiate heat.

13 Claims, 5 Drawing Sheets

PULSE TUBE REFRIGERATING SYSTEM

BACKGROUND OF THE INVENTION

1. Field of the Invention

The present invention relates to a refrigerating system and more particularly to a pulse tube type refrigerating system.

2. Description of the Prior Art

The pulse tube type refrigerating system has been first proposed in 1963 by W.E. Gifford et al. and known as a system which can produce a low temperature below 200° K. without using a movable mechanism which are to be operated under a low temperature. This type of refrigerating system has been recognized as being characterized by a simple structure and a high reliability. The refrigerating system is based on the principle which utilizes property of the working fluid under inequilibrium. Therefore, analysis of the operation of the system through equations is rather difficult. In the past, there have been developed various theories for analyzing the mechanism for producing cold temperature in the pulse tube refrigerating system, however, such theories are based on various assumptions so that the operating principle is not clearly analyzed.

A typical example of the pulse tube refrigerating system is shown in FIG. 5. There is a compressor 1 having an output port connected with a discharge line 1*a* and a suction port connected with a suction line 1*b*. The discharge line 1*a* is connected through an discharge valve 2 with a regenerator 3. The suction line 1*b* is connected with the regenerator 3. The regenerator 3 is connected with a refrigerating section 4 which is in turn connected with one end of a pulse tube 5 having a hollow interior 6. The other end of the pulse tube 5 is connected with a heat exchanger 7 of an appropriate type. Within the system, there is contained a working fluid such as helium, argon, nitrogen, hydrogen or a mixture of one of these fluids and air.

In the discharge line 1*a*, the working fluid is compressed adiabatically by the compressor 1 to a pressure of approximately 15 atms. In this stage, the working fluid is increased in temperature due to the adiabatic compression. The working fluid under pressure is then passed through an intake valve 2 into the regenerator 3 where it gives thermal energy to a medium in the regenerator 3. The working fluid is thus decreased in temperature in the regenerator 3 and introduced through the refrigerating section 4 into the pulse tube 5.

The pulse tube 5 contains working fluid and this working fluid is compressed adiabatically by the pressurized fluid from the regenerator 3 to be increased in temperature. The working fluid which has been in the pulse tube and compressed by the fluid from the regenerator 3 is then passed to the heat exchanger 7 to radiate heat into atmosphere or another medium at atmospheric temperature.

Thereafter, the outlet valve 8 is opened so that the working fluid in the system is allowed to flow through the suction line 1*b* into the compressor 1. In this stage, the working fluid in the heat exchanger 7 is returned to the pulse tube 5 to thereby expel the working fluid in the pulse tube 5. The working fluid returned from the heat exchanger 7 to the pulse tube 5 is then expanded to be decreased in temperature. The working fluid thus decreased in temperature is passed to the refrigerating section 4 to cool the medium around the section 4. With this working cycle, the medium around the refrigerating section 4 can be cooled down. There will be a temperature gradient along the length of the pulse tube 5 from the refrigerated temperature to the temperature of the heat exchanger 7. As an example, the temperature at the refrigerating section 4 is approximately 77° K. whereas the temperature at the heat exchanger 7 is approximately 320° K.

In the working stage wherein the outlet valve 8 is opened, there is a time difference between the timing wherein the working fluid which has remained in or in the vicinity of the regenerator 3 expels the fluid in the suction line 1*b* and the timing wherein the working fluid in the heat exchanger 7 is moved to the pulse tube 5. In other words, there is a difference in phase in the movement of the working fluid through the outlet valve 8 and the movement of the working fluid in the pulse tube 5. It is understood that this phase difference produces the refrigeration at the section 4.

It has been found that the conventional pulse tube type refrigerating system is disadvantageous in that the efficiency is very low as compared with other types of refrigerating systems. In a conventional pulse tube type refrigerating system, an output of 2 W under 77° K. can be obtained with an input of 1 kW. Thus, the conventional system shows a performance number $1000/2=500$.

SUMMARY OF THE INVENTION

It is therefore an object of the present invention to improve the efficiency of the pulse tube type refrigerating system.

Another object of the present invention is to provide a pulse tube type refrigerating system of a novel structure.

According to the present invention, the above and other objects can be accomplished by a pulse tube refrigerating system comprising compressing means for compressing a working fluid, heat radiating means connected with the compressing means, regenerating means connected with the heat radiating means, pulse tube means, refrigerating means between the heat radiating means and the pulse tube means, heat exchange means connected with the pulse tube means, and expansion means connected with the heat exchange means and operable with a phase difference with respect to the compressing means, whereby the working fluid from the compressing means is cooled by the heat radiating means and passed through the refrigerating means into the pulse tube means, the working fluid in the pulse tube means being compressed by the working fluid from the refrigerating means to be increased in temperature and passed to the heat exchange means to radiate heat.

In a preferable aspect of the present invention, the compressing means is connected with the heat radiating means through flexible tube means. The heat exchange means may also be connected to the expansion means through flexible tube means. It is also preferable that the heat exchange means is provided with flow regulating means such as a flow regulating valve.

The compressing means may be of a piston-cylinder type which is operated under a normal temperature. The expansion means may also be of a piston-cylinder type. The expansion means is operated under an atmospheric temperature. The expansion means is advanced in phase by approximately 50 to 130 degrees with respect to the compressing means.

In a further aspect of the present invention, the compression means and the expansion means are embodied in piston-cylinder mechanisms of double acting type so that a compound cycle system is provided.

It is possible according to the present invention to provide the refrigerating system with a plurality of low temperature sections. It is further possible to increase the efficiency of the system as a whole.

The invention will further be described with reference to preferable embodiments taking reference to the accompanying drawings.

DESCRIPTION OF THE PREFERRED EMBODIMENT

Figure 1:
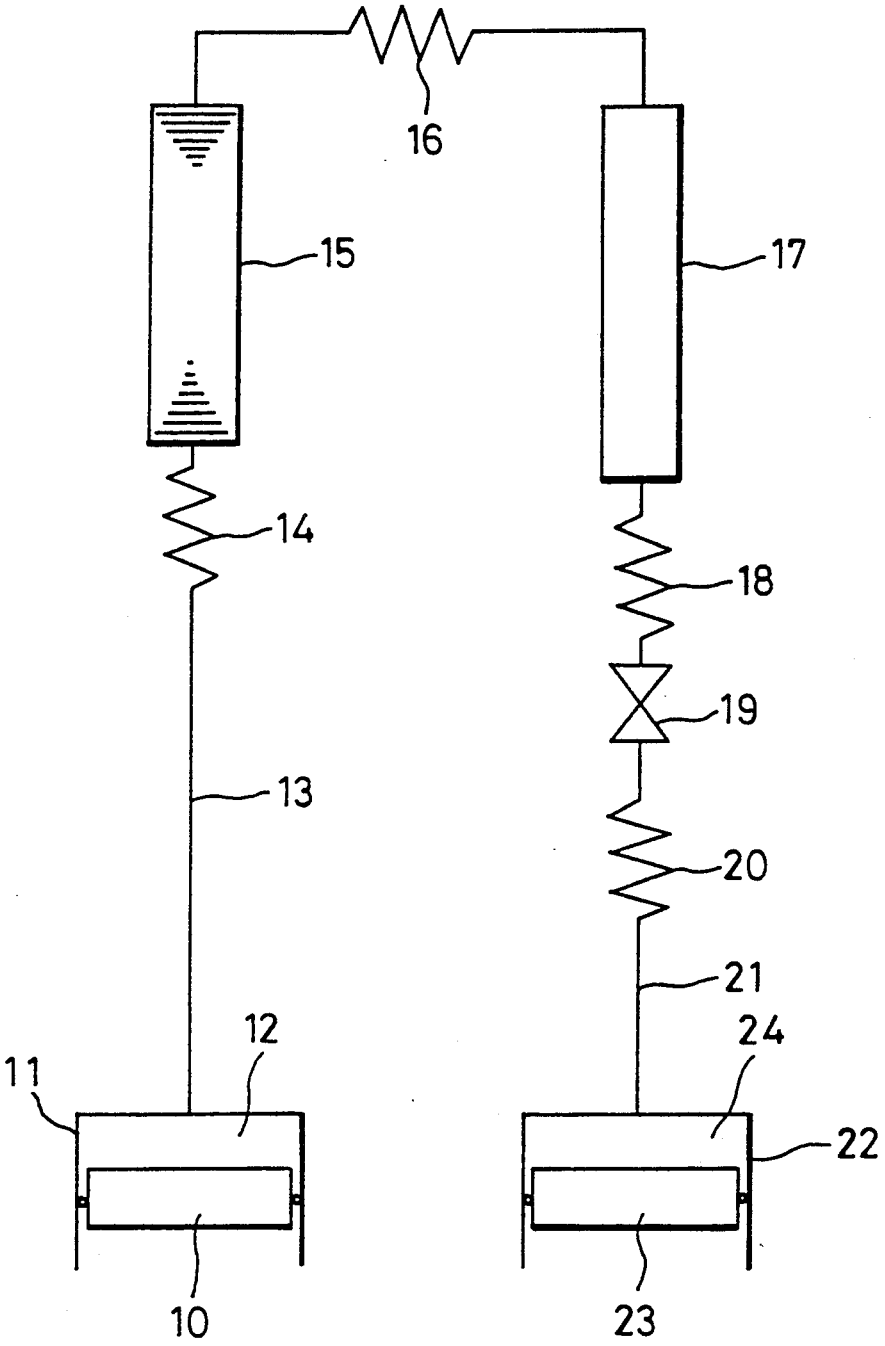
FIG. 1 is a schematic illustration of a pulse tube type refrigerating system in accordance with one embodiment of the present invention.

Referring to the drawings, particularly to FIG. 1, the pulse tube type refrigerating system shown therein includes a compressing piston 10 which is mounted in a cylinder 11 for a reciprocating movement therein. The piston 10 and the cylinder 11 define$ a compressing cavity 12. The compressing cavity 12 is connected through a flexible tube 13 with a heat radiator 14 which is in turn connected with a regenerator 15. The regenerator 15 includes heat absorbing medium such as a net of metal wires, metal balls, powders of rare metals and the like.

The regenerator 15 is connected with a refrigerating section 16 which is in turn connected with one end of a pulse tube 17 having a hollow interior. The other end of the pulse tube 17 is connected with a heat exchanger 18 which is in turn connected through a flow regulating valve 19 with a heat radiator 20. The heat radiator 20 is then connected through a flexible tube 21 with an expansion cavity 24 which is defined by a piston 23 and a cylinder 22. The piston 23 is arranged to reciprocate in the cylinder 22.

In operation the working fluid in the compressing cavity 12 is at a predetermined pressure such as 15 atms. when the piston is in the bottom dead center and compressed as the piston moves upward. The working fluid in the compressing cavity 12 is compressed to a predetermined pressure such as 25 atms. The compression takes place adiabatically so that the temperature of the fluid increases as the compression progresses. The compressed working fluid is passed through the radiator 14, the regenerator 15 and the refrigerating section 16 to the pulse tube 17.

The heat in the working fluid is radiated at the radiator 14 and further cooled down at the regenerator 15. The compressed working fluid introduced into the refrigerating section 16 and the pulse tube 17 functions to compress the working fluid which has been retained in these areas in an adiabatic manner. Thus, the working fluid is increased in temperature and moved to the heat exchanger 18. In the heat exchanger 18, the working fluid gives its heat to atmosphere or other medium so that the temperature is decreased. Then, the working fluid is introduced through the flow regulating valve 19 into the radiator 20 where the heat in the working fluid is further radiated. Then the working fluid is introduced through the flexible tube 21 into the expansion cavity 24 where the working fluid works to force the piston 23 downward. The piston 23 moves in the cylinder 22 with a phase which is advanced by 55 to 130 degrees with respect to the phase of the piston 10.

When the working fluid is compressed at the pulse tube 17, it has a temperature of approximately 350° K. and the temperature is decreased to the atmospheric temperature and the pressure is decreased to approximately 10 atms. when it is introduced into the expansion cavity 24. At this instance, the working fluid in the regenerator 15 and the refrigerating section 16 is expanded so that the temperature is decreased below 70° K.

As the piston 23 moves upward, the piston 10 is moves downward with a certain delay. The working fluid in the expansion cavity 24 is then forced in the reverse direction. A cold temperature is produced at the refrigerating section 16. It has been affirmed that an output of 25 W can be obtained under a temperature of 77° K. with a rotating speed of 350 rpm, the phase difference of 80 degrees and the input of 2 kW. The performance number is therefore 2000/25=80.

In the aforementioned structure, the pistons 10 and 23 can be operated in any appropriate manner. For example, an electromagnetic driving mechanism, a fluid dynamic driving mechanism or a mechanical device may be adopted. It is of course possible to adopt a combination of a fluid pressure and a mechanical spring.

The mechanism of the present invention can be considered as a modification of a stirling cycle refrigerating system. In a stirling cycle system, however, the expansion piston-cylinder device is placed in a low temperature section. The present invention is advantageous over the stirling cycle refrigerating system in that the expansion piston-cylinder device is located at a place where the atmospheric temperature prevails. It may be possible to form the radiator 20 as an integral part of the cylinder 22 defining the expansion cavity 24. Where the cylinder 22 and the piston 23 are made of a heat-resistant material, the radiator 20 may be omitted. In this instance, the working fluid introduced into the expansion cavity 24 may be of a temperature higher than the atmospheric temperature.

Figure 2:
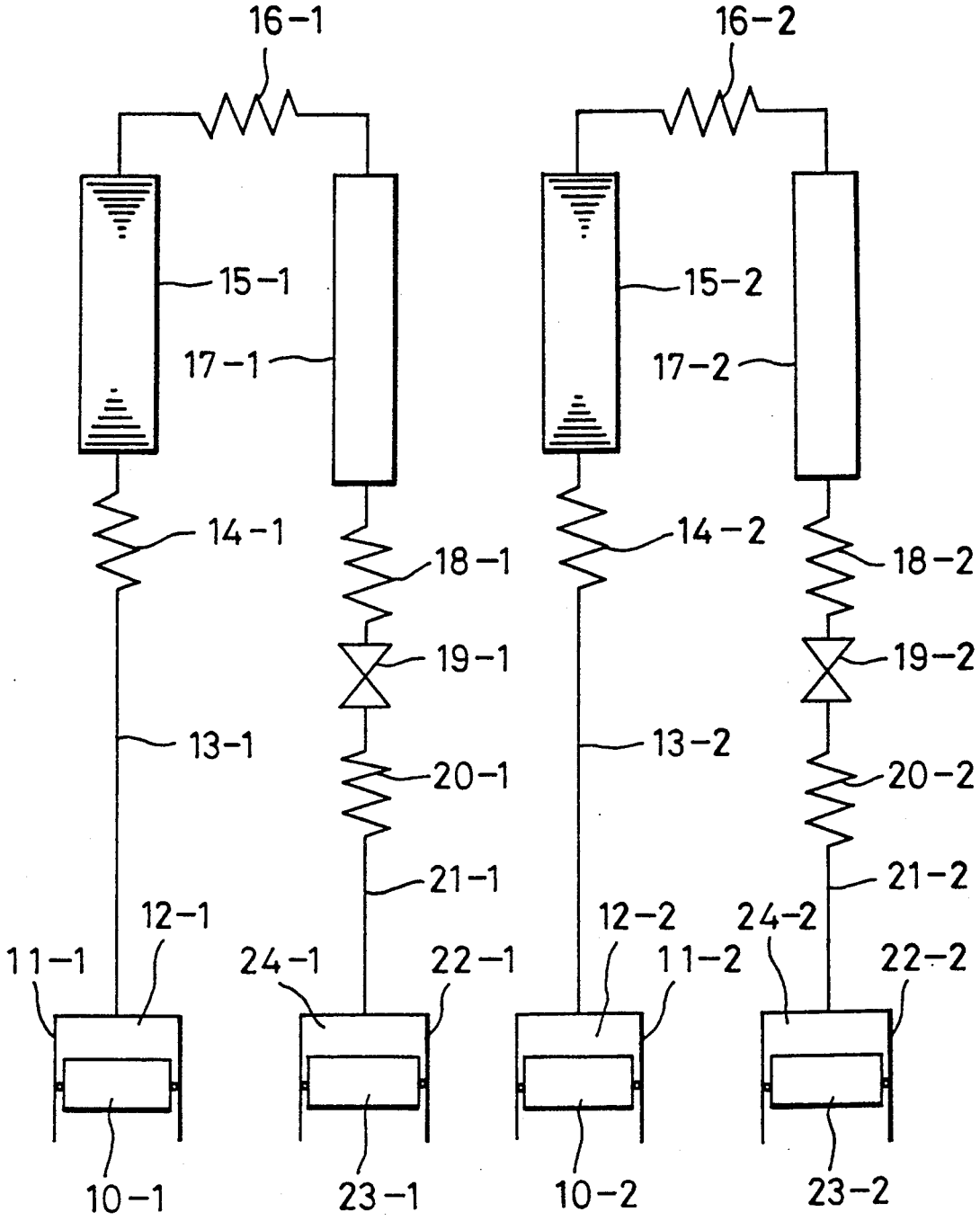
FIG. 2 is a schematic illustration of a pulse tube type refrigerating system showing a further embodiment of the present invention.

Referring now to FIG. 2 which shows a second embodiment of the present invention, the refrigerating system shown therein includes two compressing cavities and two expansion cavities. There are first and second refrigerating systems each of which is the same as the refrigerating system shown in FIG. 1. In the first system, the corresponding parts are designated by the same reference numerals with suffix 1 as in the system of FIG. 1. Similarly, in the second system, the corresponding parts are designated by the same reference numerals as in FIG. 1 with suffix 2. In this embodiment, the expansion pistons 24-1 and 24-2 are operated with 180 degrees phase advance with respect to the compression pistons 10-1 and 10-2, respectively. Further, the expansion pistons 23-1 and 23-2 are operated with a phase difference of 55 to 130 degrees with respect to the compression pistons 10-1 and 10-2, respectively. It has been verified that the performance number can be improved from 80 in the embodiment of FIG. 1 to 70 in the embodiment of FIG. 2. It is of course possible to increase the number of the systems to three or more as desired.

Figure 3:
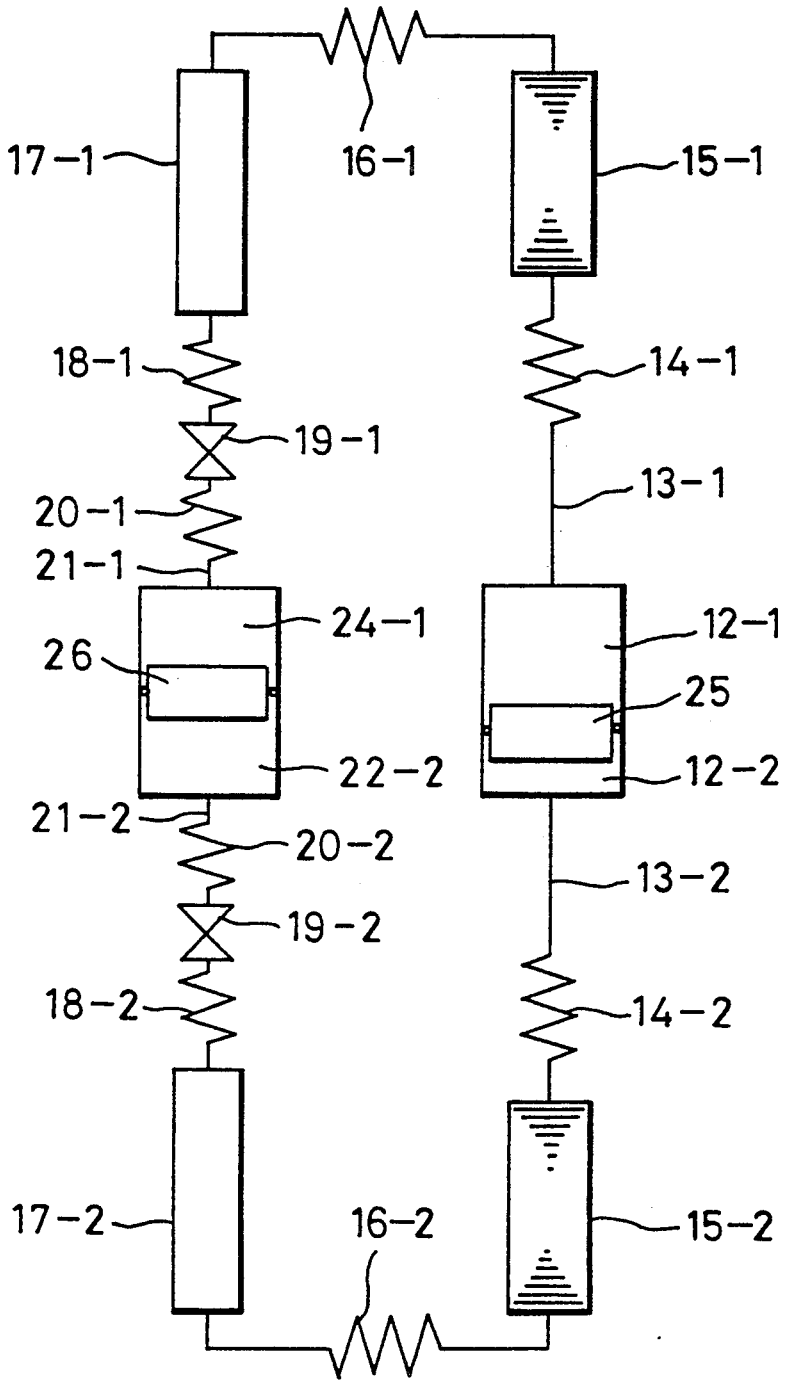
FIG. 3 is a schematic illustration of a pulse tube type refrigerating system showing still further embodiment of the present invention.

Referring to FIG. 3, there is shown another embodiment of the present invention which also includes two refrigerating systems. In each of the systems, corresponding parts are shown by the same reference numerals as in FIG. 1 with suffix 1 or 2 as the case may be. In this embodiment, the compression cavities 12-1 and 12-2 in the first and the second systems has a common piston 25. Further, the expansion cavities 24-1 and 24-2 has a common piston 26. The expansion piston 26 is operated with 55 to 130 degrees phase advance with respect to the compression piston 25.

Figure 4:
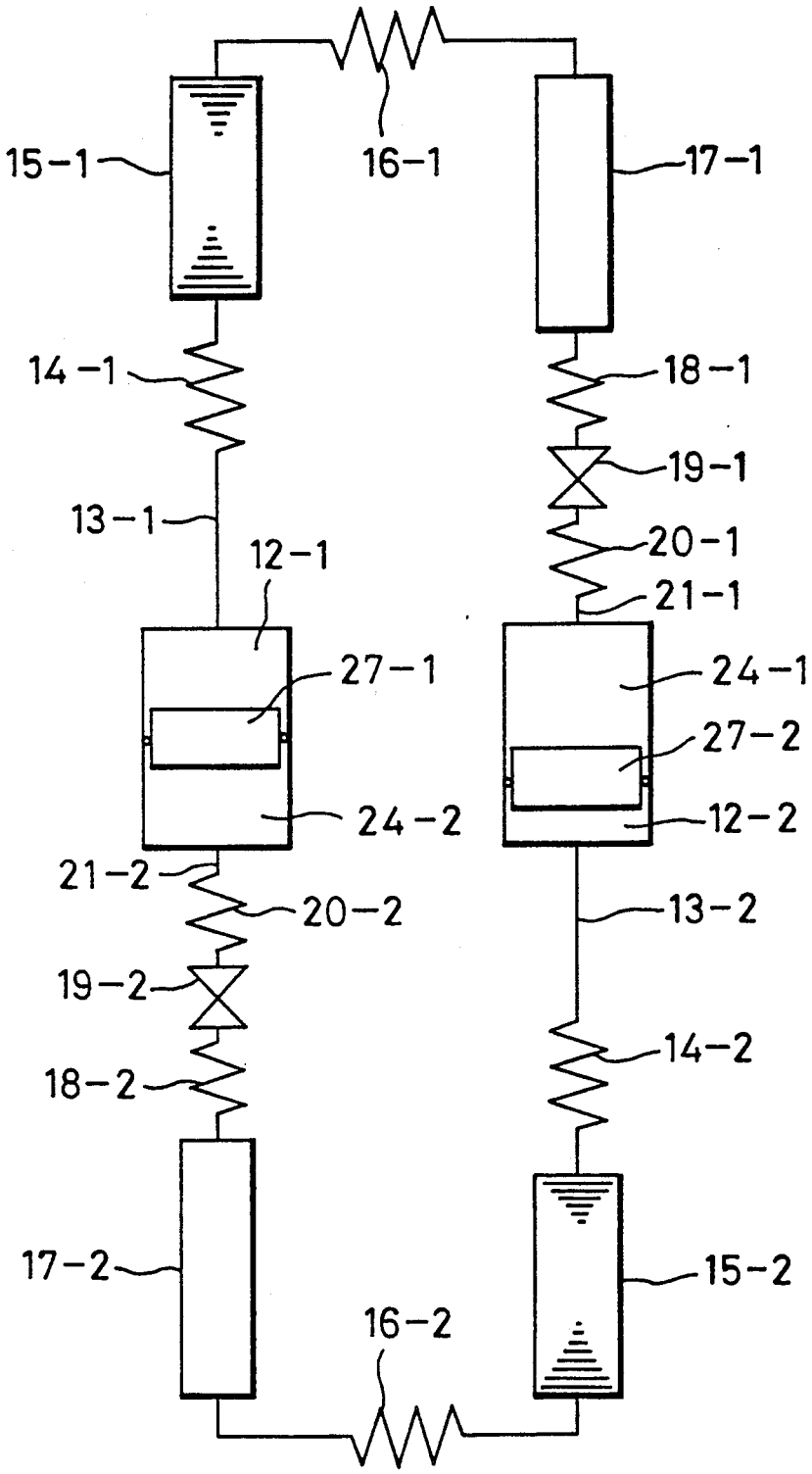
FIG. 4 is a schematic illustration showing a further embodiment of the present invention; and, FIG. 5 shows an example of a conventional system.
Figure 5:
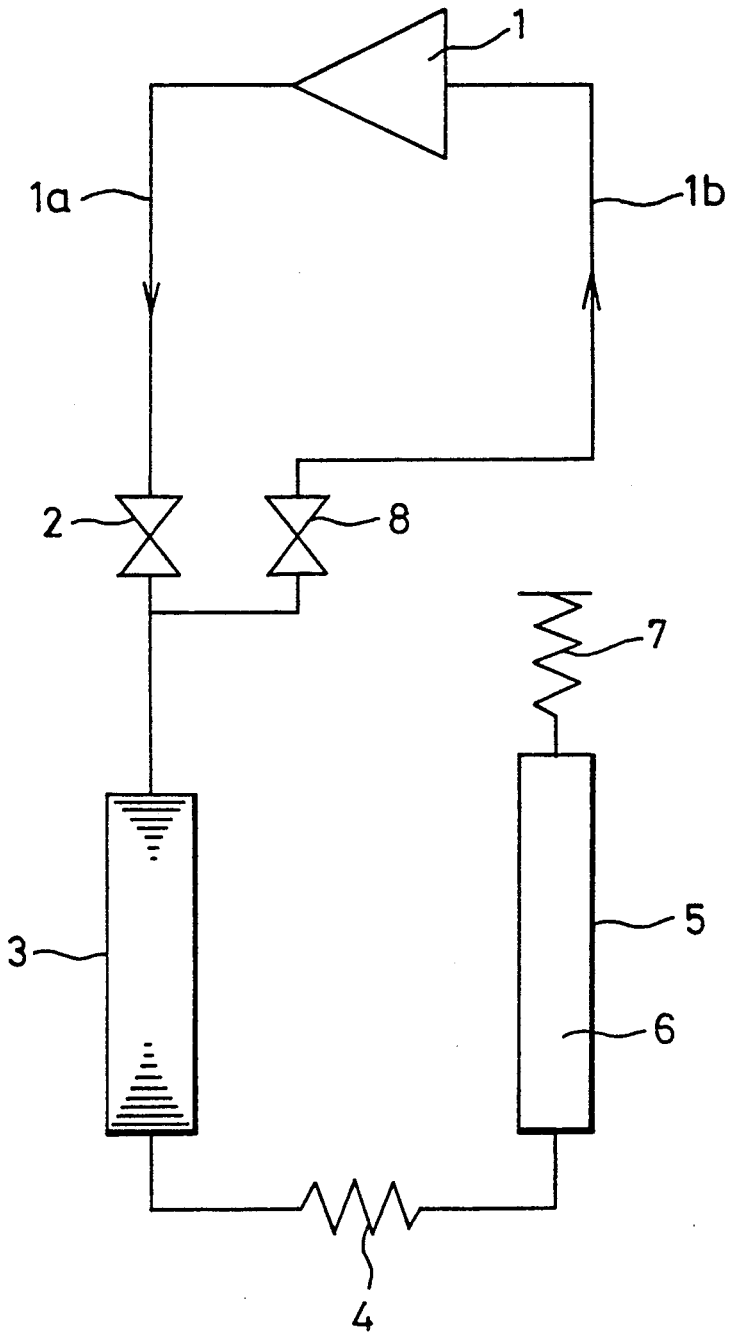
FIG. 5 (PRIOR ART)

Referring now to FIG. 4, the system shown therein is similar to that shown in FIG. 3. This embodiment is different from the embodiment shown in FIG. 3 in that the compression cavity 12-1 of the first refrigerating system and the expansion cavity 24-2 in the second refrigerating system has a common piston 27-1, whereas the compression cavity 12-2 in the second system and the expansion cavity 24-1 in the first system has a common piston 27-2. In this embodiment, the pistons 27-1 and 27-2 are operated with a phase difference so that the phase of change of the volume of the expansion cavity 24-1 or 24-2 is advanced by 55 to 130 degrees with respect to the phase of change of the volume of the compression cavity 12-1 or 12-2.

It is possible in accordance with the present invention to increase the number of pistons as desired. By increasing the number of pistons, it is possible to improve the mechanical or electromagnetic efficiency. The ratio of the expansion cavity to the compression cavity may be between 0.4 and 1.2. This ratio approximates as the temperature at the refrigerating section decreases. The volume ratio can be determined by appropriately determining the configuration of the pistons. The pistons may be driven either by mechanical means such as a crankshaft mechanism, or a swash plate mechanism, or electromagnetic means such as electromagnetic driving mechanism.

In the illustrated embodiment, the pistons are shown as of reciprocating type. However, other types of pistons may of course be used. For example, a rotary piston may be used without any problem. A scroll type compressor may also be used.

The invention has thus been shown and described with reference to specific embodiments, however, it should be noted that the invention is in no way limited to the details of the illustrated arrangements but changes and modifications may be made without departing from the scope of the appended claims.

We claim:

1. A pulse tube refrigerating system comprising compressing means for compressing a working fluid, heat radiating means connected with the compressing means, regenerating means connected with the heat radiating means, pulse tube means, refrigerating means between the heat radiating means and the pulse tube means, heat exchange means connected with the pulse tube means, and expansion means fluidically connected with the heat exchange means by a fluid flow path permitting two directional fluid flow and operable with a phase difference with respect to the compressing means, whereby the working fluid from the compressing means is cooled by the heat radiating means and passed through the refrigerating means into the pulse tube means, the working fluid in the pulse tube means being compressed by the working fluid from the refrigerating means to be increased in temperature and passed to the heat exchange means to radiate heat.

2. A pulse tube refrigerating system in accordance with claim 1 in which said expansion means is operated with 55 to 130 degrees phase advance with respect to said compressing means.

3. A pulse tube refrigerating system in accordance with claim 1 in which said compressing means is connected with said heat radiating means through flexible tube means.

4. A pulse tube refrigerating system in accordance with claim 1 in which said compressing means includes piston-cylinder means having piston means defining compressing cavity means, said expansion means including piston-cylinder means having piston means defining expansion cavity means, said piston means in said piston-cylinder means in said expansion means being operated with 55 to 130 degrees phase advance with respect to said piston means in said piston-cylinder means in said compressing means.

5. A pulse tube refrigerating system in accordance with claim 1 which further includes flow regulating means between said heat exchange means and said expansion means.

6. A pulse tube refrigerating system in accordance with claim 5 which further includes heat radiating means between said flow regulating means and said expansion means.

7. A pulse tube refrigerating system comprising a first refrigerating part including first compressing means for compressing a working fluid, first heat radiating means connected with the first compressing means, first regenerating means connected with the first heat radiating means, first pulse tube means, first refrigerating means between the first heat radiating means and the first pulse tube means, first heat exchange means connected with the first pulse tube means, and first expansion means connected with the first heat exchange means and operable with a phase difference with respect to the first compressing means, and a second refrigerating part including second compressing means for compressing a working fluid, second heat radiating means connected with the second compressing means, second regenerating means connected with the second heat radiating means, second pulse tube means, second refrigerating means between the second heat radiating means and the second pulse tube means, second heat exchange means connected with the second pulse tube means, and second expansion means connected with the second heat exchange means and operable with a phase difference with respect to the second compressing means, said first compressing means being operated with a phase difference with respect to said second compressing means.

8. A pulse tube refrigerating system in accordance with claim 7 in which said first compressing means is operated with 180 degrees phase difference with respect to said second compressing means.

9. A pulse tube refrigerating system in accordance with claim 8 in which said first and second compressing means comprises a piston-cylinder mechanism having a common piston defining compression cavities at the opposite sides of said common piston for said first and second compression means.

10. A pulse tube refrigerating system in accordance with claim 9 in which said first and second expansion means comprises a piston-cylinder mechanism having a common piston defining expansion cavities at the opposite sides of said common piston for said first and second expansion means.

11. A pulse tube refrigerating system in accordance with claim 7 in which said first compressing means and said second expansion means comprises a piston-cylinder mechanism having a first common piston which defines at one side a compressing cavity for the first compressing means and at the other side an expansion cavity for the second expansion means, said second compressing means and said first expansion means comprises a piston-cylinder mechanism having a second common piston which defines at one side a compressing cavity for the second compressing means and at the other side an expansion cavity for the first expansion means.

12. A pulse tube refrigeration system in accordance with claim 1, including a flow regulating valve positioned between said pulse tube means and said expansion means.

13. A pulse tube refrigerating system in accordance with claim 7, including a first flow regulating valve positioned between said first pulse tube means and said first expansion means, and a second flow regulating valve positioned between said second pulse tube means and said second expansion means.

* * * * *